US005650200A

United States Patent [19]

Koskinen

[11] Patent Number: 5,650,200

[45] Date of Patent: Jul. 22, 1997

[54] METHOD AND APPARATUS FOR CONTROLLING THE THICKNESS OF A COATING APPLIED TO A MOVING WEB

[75] Inventor: Jukka Koskinen, Helsinki, Finland

[73] Assignee: Valmet Corporation, Helsinki, Finland

[21] Appl. No.: 729,776

[22] Filed: Oct. 8, 1996

Related U.S. Application Data

[63] Continuation of Ser. No. 480,851, Jun. 7, 1995, abandoned.

[30] Foreign Application Priority Data

Jun. 29, 1994 [FI] Finland ..... 943134

[51] Int. Cl.[6] ..... B05D 3/04

[52] U.S. Cl. ..... 427/348; 118/63

[58] Field of Search ..... 427/348; 118/63

[56] References Cited

U.S. PATENT DOCUMENTS

| | | | |
|---|---|---|---|
| 3,329,523 | 7/1967 | Best et al. | 427/348 |
| 3,783,823 | 1/1974 | Sievert et al. | 118/63 |
| 4,858,553 | 8/1989 | Westergard et al. . | |
| 4,980,207 | 12/1990 | Sollinger . | |
| 5,101,760 | 4/1992 | Sollinger . | |
| 5,112,653 | 5/1992 | Damrau et al. . | |
| 5,179,909 | 1/1993 | Sollinger . | |
| 5,368,893 | 11/1994 | Sommer et al. | 427/348 |

FOREIGN PATENT DOCUMENTS

| | | |
|---|---|---|
| 0 352 582 | 1/1990 | European Pat. Off. . |
| WO92/00419 | 1/1992 | WIPO . |
| WO94/23127 | 10/1994 | WIPO . |

*Primary Examiner*—Katherine A. Bareford

*Attorney, Agent, or Firm*—Cohen, Pontani, Lieberman, Pavane

[57] ABSTRACT

In air-knife coating, the coating mix is applied to the paper or board web by a coating applicator, and the coating mix is doctored to the desired coating thickness by blowing a sharp air jet discharged from an air knife. The air knife doctoring separates coating mix that has not been absorbed by the web forming a filter-cake layer. The air knife is directed at the upper boundary between the filter-cake layer and the un-absorbed coating mix. The coat weight is controlled by adjusting the distance between the point of initial application of the coating mix to the web and the point of doctoring where coating mix is removed.

17 Claims, 1 Drawing Sheet

METHOD AND APPARATUS FOR CONTROLLING THE THICKNESS OF A COATING APPLIED TO A MOVING WEB

This is a continuation of application Ser. No. 08/480,851, filed Jun. 7, 1995, now abandoned.

FIELD OF THE INVENTION

The present invention relates to a method and apparatus for coating a paper or board web using an air knife as the doctoring means.

BACKGROUND OF THE INVENTION

In the use of an air knife as the doctoring means, the coating mix applied to the web is smoothed by blowing air against the web surface at a high velocity from a narrow orifice of the air knife toward the web. The air jet cuts away or removes excess coating from the web surface in the form of an atomized spray, and the emitted coating mist is collected in a special chamber and recycled back to the coating mix pool. The use of the air knife results in a constant-thickness coat, and the profile of the coated paper or board conforms to the base web profile. The covering power of the applied coat is high.

In air-knife coating, excess coating is doctored away with the help of a sharp air jet discharged from a narrow nozzle orifice. The velocity of the air jet may be as high as 0.7–0.8 Mach. Typically the pressure of the air jet is 0.2–1 bar. The principal reason for using air-knife coating is that this method achieves a coat with an extremely constant thickness and high covering power owing to the good conformance of this contour-type coat to the base paper or board surface profile. An essential factor in achieving such a contour-type coat is filter cake formation. The filter-cake layer is formed when the water and the binding agents of the coating mix are absorbed from the fluid coating mix by the base paper. The filter-cake layer is formed along the contour of the paper or board sheet surface. Then, the air jet can cut off practically all excess fluid coating down to the filter-cake layer.

Conventionally, the control of coat weight in air-knife coating has been attempted by means of adjusting the air-knife pressure. Herein, the control facilities are rather limited, because when a light coat weight is desired, also a portion of the top surface of the filter-cake layer should be removed, which requires use of high-power air jets and causes a number of problems such as fuming. on the other hand, when heavy coat weights are desired, stability problems arise in the thickness control of the coating layer, because the air jet must perform the cutting of excess coating in a fluid-state coating layer lacking a well-defined phase boundary.

In air-knife coating, application and doctoring of the coat form two, clearly separate steps. During the application step the coating mix is metered onto the web and the applied amount of coating is larger than the desired final coat weight. The excess coating is cut off or removed with the help of an air jet discharged from a narrow orifice. Between the application and the doctoring steps, interaction occurs between the paper sheet and the coating mix, whereby water and binding agents are absorbed to the base sheet chiefly from the layers of coating closest to the web surface. This absorption of water and binding agents is called penetration, which phenomenon involves an increase in the solids content of the layers of coating closest to the web surface. This increase in solids content results in filter cake formation, which means that onto the base sheet is deposited a coating layer whose solids content is high enough to cause settling of the coating mix, whereby the coating ceases to flow.

Usually the coarse control of coat weight is implemented by adjusting the doctoring conditions so that doctoring is performed based on the filter-cake phenomenon. The fine control of coat weight is then accomplished by adjusting the air jet pressure. However, in practice the air jet is capable of cutting off only a limited amount of coating as, when a light coat weight is desired, the required air jet power increases dramatically. Use of a high-power jet results in deleterious fuming of the coating and increased noise emission from the air knife. The apparatus also needs effective compressed-air generators and as the air blown from the orifice must be oil-free and clean, the total costs of the apparatus rise rapidly with the increase in the required doctoring effect and resulting elevated air demand. By contrast, at heavy coat weights the air-knife coating method fails to give a smooth coating as the low-viscosity, low-solids coating mix portion to be doctored detaches irregularly from the web surface and the doctoring action becomes extremely unstable to control. By modifying the properties of the coating mix, the thickness of the filter-cake layer formed on the web surface between the application step and the doctoring step can be affected. Doctoring succeeds best along the upper surface of this settled layer, whereby also the doctoring step behaves in a stable manner. However, the control of the coating mix properties is extremely clumsy and difficult to manage in a controlled manner. The preparation of different coating mix formulas is time-consuming, which makes run-time thickness control of the filter-cake layer of the applied coating impossible in practice. Hence, this approach can be used only for minor adjustment of the coating process conditions.

SUMMARY OF THE INVENTION

It is an object of the present invention to achieve a method capable of controlling coat weight in air-knife coating without resorting to an excessive increase of air-knife pressure.

The goal of the invention is accomplished by utilizing the properties of the filter cake phenomenon occurring in a wet coating mix layer applied onto a web and by controlling the time difference between the application and doctoring steps.

The invention offers significant benefits.

The doctoring action of air-knife coating can be optimized well and the coat weight may be controlled accurately. According to the present invention, one of the factors affecting the coat weight is varied, while the other parameters affecting the process conditions such as base sheet grade, coating mix, web speed and air-knife pressure are kept at their optimal standard values. The air-knife pressure remains at a reasonably low level, whereby spray formation from the doctored coating is reduced and less soiling of the equipment occurs. The coat weight remains constant during coating as the doctoring is performed along the natural phase boundary.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
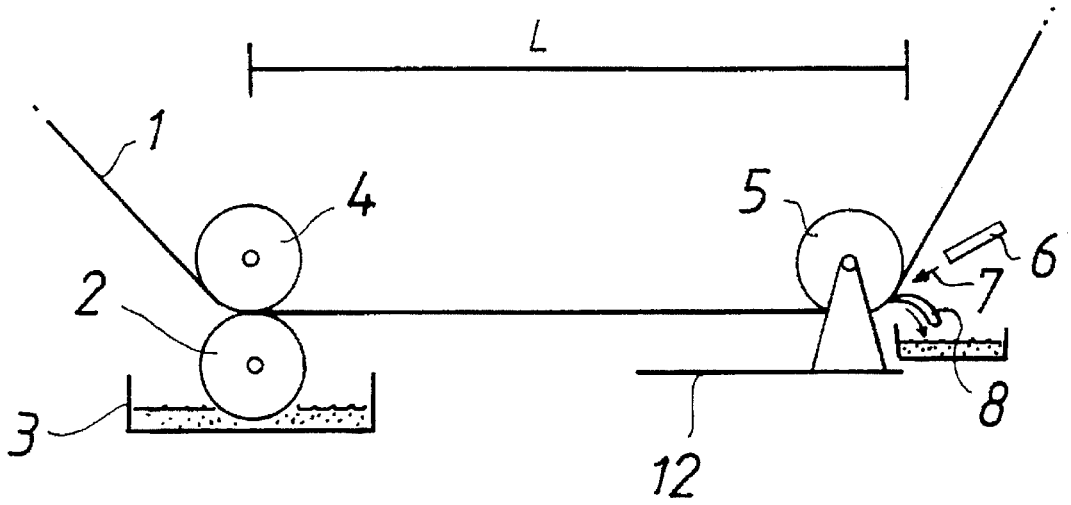
FIG. 1 is a schematic illustration of the air-knife coating step in accordance with the present invention.

In air-knife coating the coating mix is applied onto a moving web 1 using any suitable application method. Now referring to the embodiment of the present invention illustrated in FIG. 1, the applicator used therein is an applicator roll 2. The applicator roll 2 lifts the coating mix from the pool 3 and transfers the mix onto the web 1 passing over a first backing roll 4. As the particular application method used is irrelevant to the operating principle of the present invention, any suitable applicator device can be used as the applicator. After the application point, the web passes to a second backing roll 5. The web 1 is turned at the second backing roll 5 and proximate to the roll 5 an air knife 6 is positioned which discharges a doctoring air jet 7 toward the web. Coating mix mist 8 cut off or reflected from the web 1 is gathered to a collecting vat. The air knife 6 and backing roll 5 are located a distance L from the coating applicator 2, 3, 4.

Figure 2:
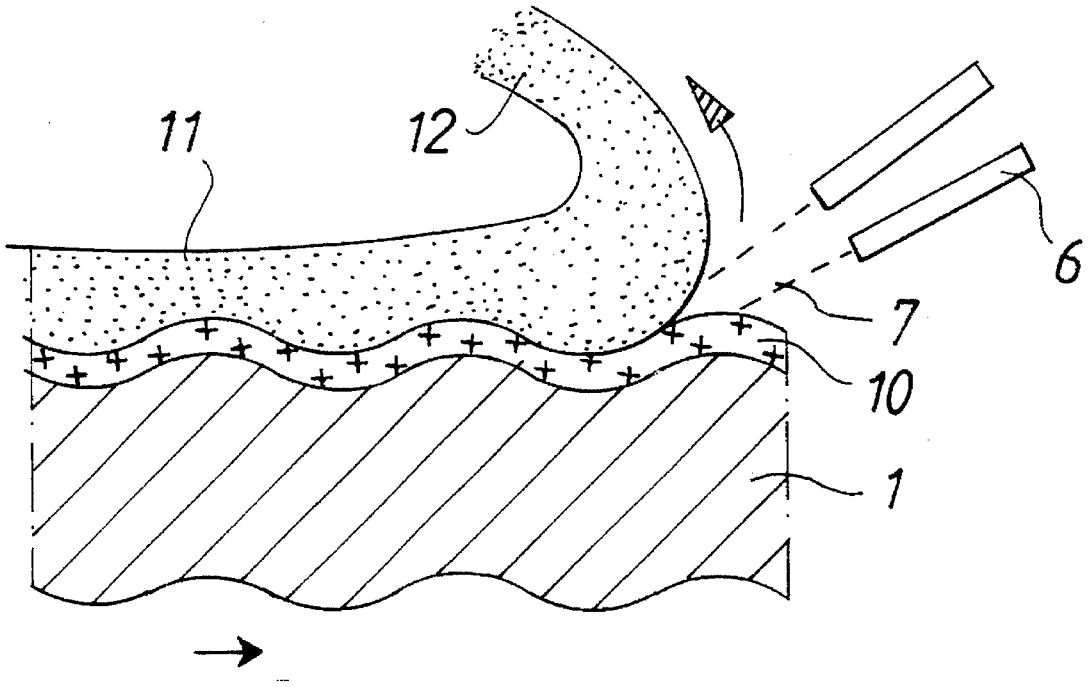
FIG. 2 is a schematic detailed illustration of the doctoring step carried out using an air-knife.

In air-knife coating, the thickness of the coating layer adhering to the web is most advantageously adjusted by controlling the thickness of the filter-cake layer formed on the web 1 after the application step. Now referring to FIG. 2 on the left side, the base sheet 1, or the web, is illustrated with the filter-cake layer 10 settled on it and the fluid coating mix layer 11 remaining above the filter-cake layer 10. The settled filter-cake layer 10 and the fluid coating mix layer 11 together represent the applied coating mix layer. The fluid coating mix layer 11 is removed as mist 12, FIG. 2, right side.

After the application step, an interaction occurs between the applied coating mix 11 and the base sheet 1 resulting in the formation of the filter-cake layer 10. The filter-cake layer 10 is formed when the water and binding agents of the coating mix are absorbed from the fluid coating mix by the base sheet 1. This phenomenon is called penetration and it causes an increase in the solids content of the layer of coating closest to the base sheet 1. The degree of penetration is dependent on the base sheet properties including its porosity, absorption capacity, temperature and initial moisture content; the properties of the coating mix including its water retention capacity, temperature and solids content; as well as the contact time of the mix with the base sheet, which is determined by the web speed and the distance between the application point and the doctoring point. The increase of solids content related to penetration results in the formation of the filter-cake layer 10 on the base sheet top surface. In this layer, the solids content increase is so high as to cause settling of the coating mix, that is, the coating mix ceases to flow. Now, when the air jet 7 of the air knife 6 impinges on the coating mix applied on the web 1, the upper fluid coating mix layer 11 is easily cut off or removed, while substantially higher air knife power is required to rip or peel off material from the filter-cake layer 10. Hence, a natural boundary is formed in the applied coating along which the jet 7 of the air knife 6 can easily remove the excess layer 11 of applied coating.

When other process parameters are maintained constant, the thickness of the filter-cake layer 10 is dependent on the penetration time only. The longer the time lapse between the doctoring and application steps, the more water will be absorbed by the base sheet and the thicker the settled filter-cake layer on the coating will be. The penetration time itself is determined by the web speed and the distance L between the application point and the doctoring point. As the web speed is preferably kept constant, the penetration time can be varied by adjusting the distance between the application point and the doctoring point. Such distance adjustment can be implemented by, e.g., arranging the air knife 6 with its backing rolls 5 to be slidably movable on a guide 12. Alternatively, either the applicator 2, 3, 4 or even both of these units can be movable. In cases where a relatively short distance adjustment span is sufficient, adjustment of the air knife alone will be sufficient. If a wire is used to support the web between the points of application and doctoring, the air knife position is advantageously adjustable, whereby the adjustment span may comprise the entire distance between the point of application and the backing or turning roll. Obviously, some adjustment arrangements may additionally need a means of web length compensation. As such position and compensation adjustment arrangements are familiar to a person of ordinary skill in the art, their detailed description is omitted herein.

While the distance adjustment can be preset prior to starting the coater, coat weight control may usually also be necessary during running and at least in the start-up phase of running to set the coat weight accurately and to maintain a constant value of coat weight.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. A method for controlling a thickness of a coating applied to a moving paper or board web comprising:

applying a coating mix to a surface of the moving web at an application point, the applied coating mix having a thickness greater than a desired final coating layer thickness;

removing a portion of the applied coating mix from the moving web at a doctoring point by directing a jet of air toward the surface of the web to which the coating mix has been applied to result in a finished coated web, the doctoring point being a distance downstream of the application point in a direction of movement of the web; and adjusting the distance between the application point and the doctoring point so that an amount of a component of the coating mix absorbed by the web between the application point and the doctoring point is adjusted so that the desired final coating layer thickness is obtained after the removing step, wherein the distance is adjusted during start-up of a coating operation and during running of the coating operation when at least one of a new web is being coated and the desired final coating layer thickness is varied.

2. The method of claim 1, wherein the distance between the application point and the doctoring point is adjusted by adjusting a position of the application point.

3. The method of claim 2, wherein the moving web travels at a constant web speed from the application point to the doctoring point, water retention capacity, temperature and solids content of the coating mix applied in said applying step remain constant during said applying step, and the jet of air is directed toward the web in said removing step by an air knife operating at a constant air pressure.

4. The method of claim 1, wherein the distance between the application point and the doctoring point is adjusted by adjusting a position of the doctoring point.

5. The method of claim 4, wherein the moving web travels at a constant web speed from the application point to the doctoring point, chemical and physical properties of the coating mix applied in said applying step remain constant during said applying step, and the jet of air is directed toward the web in said removing step by an air knife operating at a constant air pressure.

6. The method of claim 1, wherein the moving web travels at a constant web speed from the application point to the doctoring point, water retention capacity, temperature and solids content of the coating mix applied in said applying step remain constant during said applying step, and the jet of air is directed toward the web in said removing step by an air knife operating at a constant air pressure.

7. The method of claim 1, wherein the distance between the application point and the doctoring point is adjusted by adjusting a position of the application point and a position of the doctoring point.

8. An apparatus for controlling thickness of a coating applied to a moving paper or board web comprising:

an application station where a coating mix is applied at an application point to a surface of the moving web, the applied coating mix having a thickness greater than a desired final coating layer thickness; and a doctoring station where a portion of the applied coating mix is removed from the moving web at a doctoring point by directing a jet of air toward the surface of the web to which the coating mix has been applied to result in a finished coated web, the doctoring point being a distance downstream of the application point in a direction of movement of the web;

wherein the distance between the application point and the doctoring point is adjustable so that an amount of a component of the coating mix absorbed by the web between the application point and the doctoring point is adjustable so that the desired final coating layer thickness is obtained when the web leaves said doctoring station, and wherein the distance is adjusted during start-up of a coating operation and during running of the coating operation when at least one of a new web is being coated and the desired final coating layer thickness is varied.

9. The apparatus of claim 8, wherein the jet of air directed toward the moving web at said doctoring point comprises an air knife operating at a constant air pressure.

10. The apparatus of claim 9, wherein a location of the application point is adjustable.

11. The apparatus of claim 10, wherein a location of said air knife is adjustable.

12. The apparatus of claim 9, wherein a location of the doctoring point is adjustable.

13. The apparatus of claim 12, wherein 9 location of said air knife is adjustable.

14. The apparatus of claim 9, wherein a location of said air knife is adjustable.

15. The apparatus of claim 8, wherein a location of the application point is adjustable.

16. The apparatus of claim 8, wherein a location of the doctoring point is adjustable.

17. The apparatus of claim 8, wherein a location of the application point and a location of the doctoring point are adjustable.

* * * * *